US006816127B2

(12) United States Patent
McKivergan et al.

(10) Patent No.: US 6,816,127 B2
(45) Date of Patent: Nov. 9, 2004

(54) LOW PROFILE TRI-FILAR, SINGLE FEED, CIRCULARLY POLARIZED HELICAL ANTENNA

(75) Inventors: Patrick Daniel McKivergan, Scotts Valley, CA (US); Court Emerson Rossman, Scotts Valley, CA (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/604,371

(22) Filed: Jul. 15, 2003

(65) Prior Publication Data

US 2004/0108966 A1 Jun. 10, 2004

Related U.S. Application Data

(63) Continuation-in-part of application No. 10/314,685, filed on Dec. 9, 2002, now Pat. No. 6,738,026.

(51) Int. Cl.[7] ..... H01Q 1/36; H01Q 21/00
(52) U.S. Cl. ..... 343/895; 343/893
(58) Field of Search ..... 343/818, 853, 343/893, 895, 700 MS, 816, 820, 833, 835

(56) References Cited

U.S. PATENT DOCUMENTS 6,639,559 B2 * 10/2003 Okabe et al. ..... 343/700 MS
6,697,025 B2 * 2/2004 Koyanagi et al. ..... 343/741
6,759,990 B2 * 7/2004 Rossman ..... 343/700 MS

* cited by examiner

*Primary Examiner*—Tuyet Vo
*Assistant Examiner*—Minh Dieu
(74) *Attorney, Agent, or Firm*—Holland & Hart

(57) ABSTRACT

A low-profile, tri-filar, helix antenna having circular polarization (CP) includes a single feed, in the absence of an internal feed network. The antenna includes three metal, bent, quarter-wave monopoles that are physically positioned at 0, 120, and 240 degrees, respectively, on a top flat surface of the antenna. One of the monopoles is directly-fed, and the other two monopoles are parasitically coupled to the directly-fed monopole. Metal perturbations on one or both of the two parasitic monopoles control their coupling-phase to the directly-fed monopole. One of the parasitic monopoles couples at positive 120 degrees to the directly-fed monopole, and the other parasitic monopole couples at negative 120 degrees to the directly-fed monopole. Various perturbation options generate this CP phasing. One of the parasitic monopoles can have a capacitive shunt, and the other parasitic monopole can have a series inductance, or only one parasitic monopole can include a perturbation, either capacitive or inductive, depending on the sense of the CP that is desired. The three monopoles are supported by a dielectric substrate, or they are free-standing. A ground plane is provided directly under the three monopoles.

12 Claims, 9 Drawing Sheets

LOW PROFILE TRI-FILAR, SINGLE FEED, CIRCULARLY POLARIZED HELICAL ANTENNA

CROSS REFERENCE TO RELATED APPLICATIONS

This application is a continuation-in-part of U.S. non-provisional patent application Ser. No. 10/314,685, filed on Dec. 9, 2002 now U.S. Pat. 6,738,026 and entitled LOW PROFILE TRI-FILAR, SINGLE FEED, HELICAL ANTENNA.

FIELD OF THE INVENTION

This invention relates to the field of radio communications, and more specifically to spiral or helical antennas for use in wireless communication devices and systems.

BACKGROUND OF THE INVENTION

Small, low profile, circular polarized (CP) antennas are used in the mobile communication industry, usually for satellite communication. As the demand for mobile handsets increases, there is a growing need for antennas of this type, and especially for low cost GPS antennas.

One solution to providing a low profile CP antenna is a patch or microstrip antenna. In order to achieve circular polarization, patch antennas need to be a half wavelength long. A patch antenna's free-space half wavelength is usually too long for the compact space that is provided within a wireless communications device, of which a mobile handset is an example. As a result, the physical size of such a patch antenna must be reduced dramatically, using ceramics having a high dielectric constant. However, the use of ceramics having a high dielectric constant increases antenna cost, and also reduces the efficiency of the patch antenna.

FIG. 1A shows a standard-technology, dielectric-loaded, ceramic-body, hexagonal patch antenna 10 that is tuned to the global positioning system (GPS) frequency (1575.42 MHz, referred to as L1) wherein a high dielectric constant (er=40) ceramic body portion 11 was used to reduce the physical size of patch antenna 10 to less than one inch, which size is usually desirable for mobile wireless communication applications.

FIG. 1B shows the frequency/magnitude characteristic of antenna 10, wherein antenna 10 included a ceramic body portion 11, a top-located metal radiating/receiving surface 12 that lies in the X-Y plane of FIG. 1B, an off-center feed conductor 13 that extends in the Z-direction in FIG. 1B and was connected to a metal-plated top surface 12, a vertex-to-vertex dimension 14 of about 0.88 inch, and a flat-to-flat dimension 15 of about 0.72 inch.

For wireless communications systems that can tolerate relatively large antennas, the following CP antennas are standard solutions: (1) single helix antennas which have a single feed and are typically a few wavelengths tall, (2) multi-filar helix antennas that have a 90 degree hybrid and are that are typically a few wavelengths tall, (3) crossed dipole antennas that have a 90-degree hybrid and are typically a quarter wavelength tall over a ground plane, or (4) spiral antennas that have a single balanced feed and are typically a quarter wavelength tall over a ground plane.

SUMMARY OF THE INVENTION

This invention provides a small, low-profile, tri-filar helix antenna, which can have either linear polarization or CP, the antenna being provided with a single feed, and the antenna having no internal feed network.

Antennas in accordance with the invention include three metallic, bent, quarter wave monopoles, wherein only one of the monopoles is fed, and wherein the other two monopoles are parasitically coupled to the fed-monopole.

The three bent monopoles of the invention are physically positioned at 0, 120, and 240 degrees, respectively. The three monopoles are self-supporting, or they are supported on a relatively flat dielectric surface. Only one of the three monopoles is fed, for example using an inductive shunt match. The other two monopoles are strongly coupled to, and parasitically feed from, the directly-fed monopole. The two parasitic monopoles are fed at phases that are controlled by the incorporation of, or by the non-incorporation of, metal perturbations within the two parasitic monopoles.

In order to induce linear polarization, no metal perturbations are used within the two parasitic monopoles, and the two parasitic monopoles are coupled at positive 120 degrees to the directly-fed monopole.

In order to induce CP, one of the two parasitic monopoles couples at positive 120 degrees to the directly-fed monopole, and the other parasitic monopole couples at negative 120 degrees to the directly-fed monopole. A metal perturbation on a given parasitic monopole operates to offset the resonant frequency of that parasitic monopole, which in turn affects the phase of coupling of that parasitic monopole to the fed-monopole.

Various metal perturbation options are available in order to generate the phase of this coupling to the directly-fed monopole. One of the parasitic monopoles can have a capacitive shunt, and the other parasitic monopole can have a series inductance, or only one parasitic monopole can have a metal perturbation, either a capacitive perturbation or an inductive perturbation, depending on the sense of the CP that is desired.

The three monopoles in accordance with the invention can be physically supported by a dielectric substrate member, or the three monopoles can be constructed of a material that renders the monopoles free-standing. A metallic ground plane is desirable directly under the three monopoles.

Antennas in accordance with the invention find utility as replacements for a dielectrically-loaded, single feed, CP patch antenna.

Antennas in accordance with the invention do not require dielectric loading. Hence, antennas in accordance with the invention are a less expensive choice for narrow band CP applications.

Antennas in accordance with an embodiment of the invention include three bent quarter wave monopoles, wherein only one of the bent monopoles is fed, and wherein the other two bent monopoles are parasitically coupled to the fed-monopole.

The bent monopoles were, for example, physically positioned at 0, 120, and 240 degrees, respectively. Only one of the bent monopoles was fed, for example with an inductive shunt match. The other two bent monopoles were excited parasitically from the fed-monopole with phases that were controlled by the incorporation of, or by the non-incorporation of, perturbations on or within the two parasitically-fed monopoles.

In antennas constructed and arranged in accordance with the invention the magnitude of the above-described parasitic coupling was relatively large (for example about −6 dB), and this relatively large parasitic coupling between the directly excited monopole and the two parasitic monopoles provided that the antenna generated a symmetric radiation pattern. This relatively large parasitic coupling also effectively acts as a feed network to the two parasitically coupled monopoles, and allows the antenna to have just one of the monopoles directly excited. This relatively large parasitic coupling is, to a large extent, controlled by the width of a capacitive gap that existed between the two parasitic monopoles and the fed-monopole.

In summary, the present invention provides a small, low-profile, single feed, linear polarized or CP, tri-filar, helix antenna having three bent quarter wave monopoles that are physically positioned at about 0, 120, and 240 degrees, respectively. The outer perimeter of the antenna can be a hexagon, or it can be circular, it can approach a circular shape, or it can have a number of sides equal to 6×N where N is an integer that is greater then zero.

Linear antenna polarization is produced when no perturbations are provided for either of the two parasitic monopoles, in which case both of the parasitic monopoles are excited parasitically in-phase at positive 120 degrees.

In order to produce CP, metal perturbations are applied to the two parasitic monopoles in order to generate a positive 120 degree parasitic coupling in one of the parasitic monopoles, and to in order to generate a negative 120 degree parasitic coupling in the other of the two parasitic monopoles.

Various perturbation options can be used to generate the above phasing. For example, one of the two parasitic monopoles can include a capacitive shunt, and the other parasitic monopole can include an inductive shunt. Or, only one of the two parasitic monopoles can be provided with a perturbation, either a capacitive perturbation or an inductive perturbation, depending on the sense of the CP that is desired.

The reactive-capacitance or reactive-inductance perturbations can be provided either by shaping the metal legs of the parasitic monopoles, or by connecting discrete capacitive or inductive electrical components to the parasitic monopoles.

With only one monopole directly fed, the large coupling between this directly-fed monopole and the two parasitic monopoles acts as a feed network to the two parasitic monopoles. It is desirable that all three monopoles be fed with equal RF energy levels in their resonant condition, such that the three monopole antenna will generate three symmetric radiation patterns.

In practice it is desirable that one half of the RF energy that is provided as an input to the directly-fed monopole be coupled to the two parasitic monopoles, and that the other half of this RF energy be radiated into free space.

If coupling from the directly-fed monopole to the two parasitic monopoles is significantly larger than this one-half amount, each of the three monopoles may act as a poor radiator, and the efficiency of the three monopole antenna may be reduced. If the coupling from the directly-fed monopole to the two parasitic monopoles is significantly smaller than this one-half amount it may be difficult to parasitically excite the two parasitic monopoles in order to generate CP.

DETAILED DESCRIPTION OF THE PREFERRED EMBODIMENT

Figure 2:
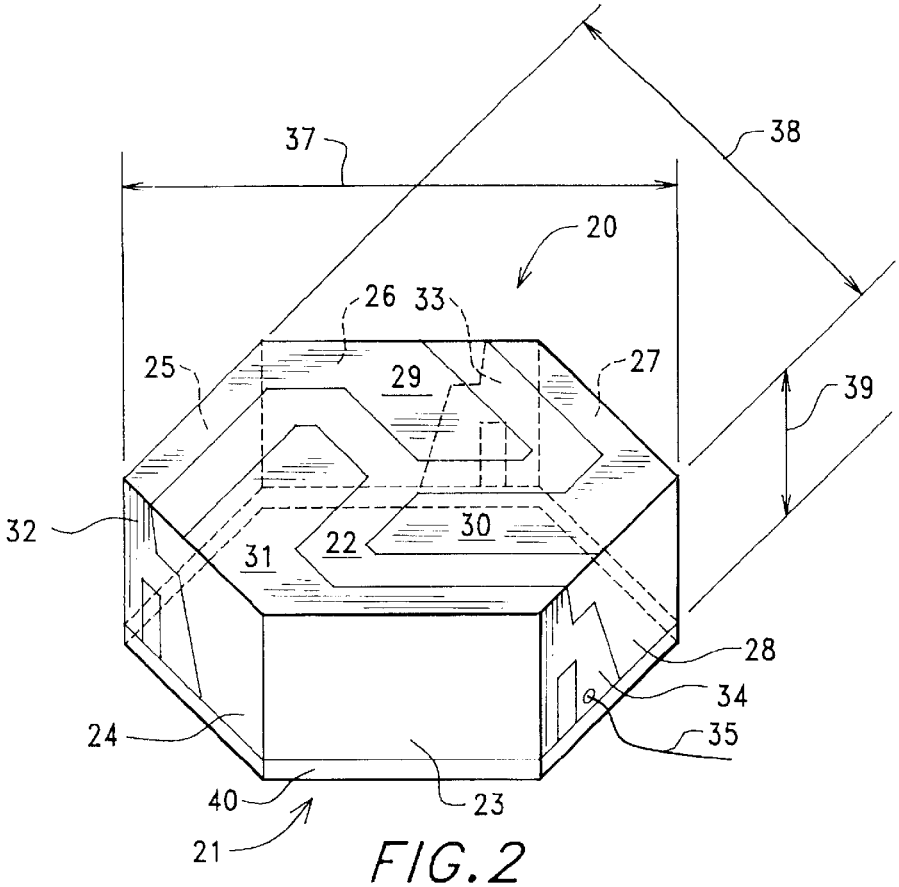
FIG. 2 is a top perspective view of a three-monopole, single-feed, antenna in accordance with the invention, the antenna having no metal perturbations associated with the antenna's three generally identically shaped quarter wave metal monopoles, this figure showing a precursor geometry that pertains to other embodiment of the invention.

FIG. 2 is a top perspective view of a single feed, three-monopole antenna 20 in accordance with the invention.

Antenna 20 includes a plastic or ceramic, electrically non-conductive, rigid, dielectric, and hexagon-shaped support member 21 having a planar top surface 22, a planar bottom surface that is generally parallel to top surface 22, and six side walls 23–28 that extend downward and generally perpendicular to top surface 22. As mentioned above, shapes other than hexagonal can be provided within the spirit and scope of the invention.

Figure 3:
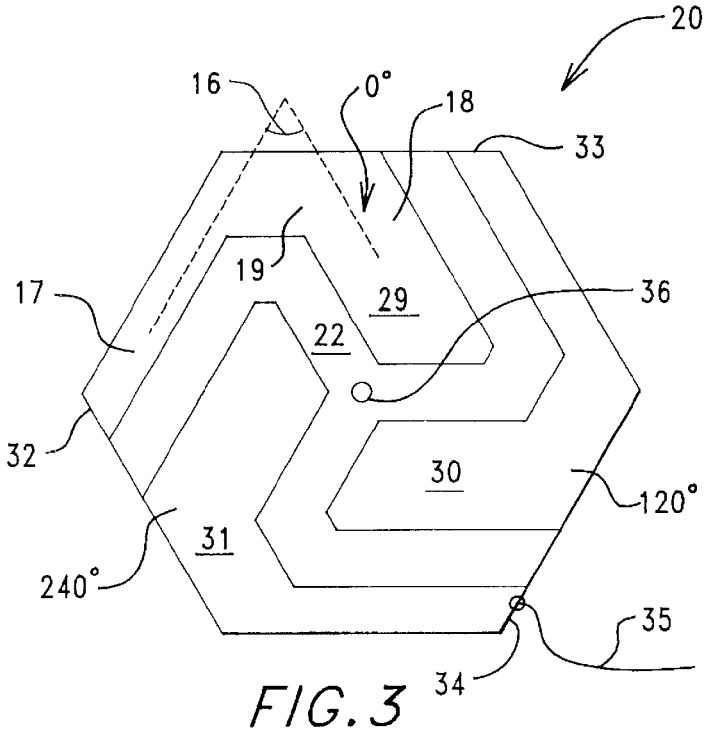
FIG. 3 is a top view of three-monopole antenna of FIG. 2 showing that the antenna's top surface includes three coplanar and quarter wave metal monopole patterns that are physically located at 0-degrees, 120-degrees and 270-degrees, respectively, about the top surface of the antenna.

FIG. 3 is a top view of three-monopole antenna 20. As seen in FIGS. 2 and 3, the top surface 22 of non-conductive support member 21 carries three coplanar, bent, quarter wave and metal monopole patterns 29–31 that are physically located at 0-degrees, 120-degrees and 270-degrees, respectively about top surface 22, as is perhaps best shown in FIG. 3.

Figure 4:
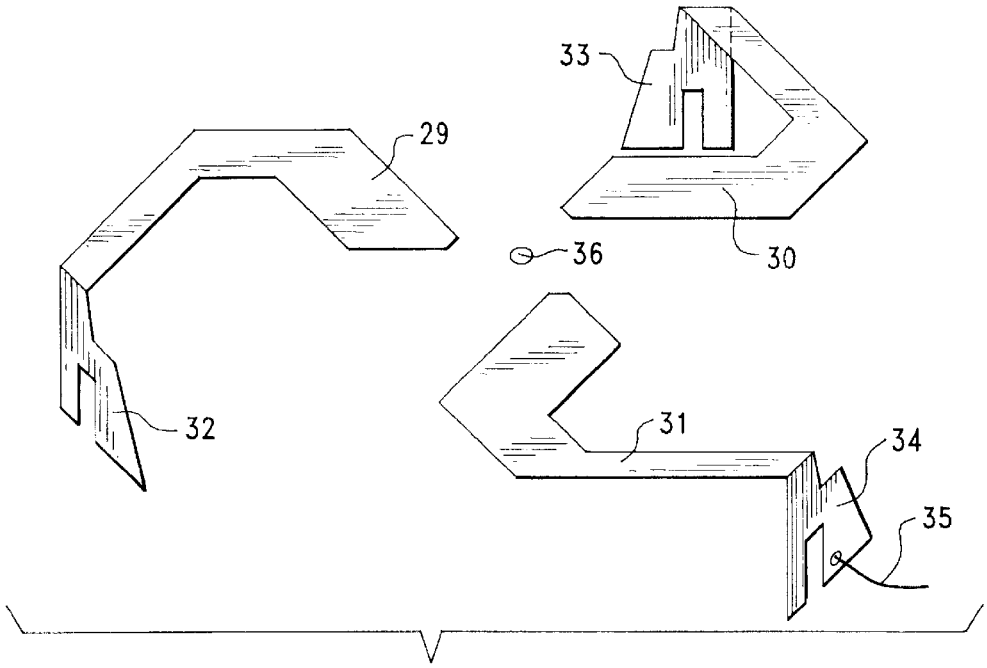
FIG. 4 is an exploded view that shows the physical positioning and the three-dimensional shape of the three metal patterns that form the three monopoles of the FIG. 2 antenna.

FIG. 4 is an exploded view that shows the three-dimensional shape of the three metal patterns that form the three bent and quarter wave monopole patterns 29–31. In this embodiment of the invention, but without limitation thereto, the three quarter wave monopoles 29–31 have a generally identical three-dimensional geometric shape.

As seen in FIGS. 2 and 4, the base of each of the three quarter wave monopole metal patterns 29–31 includes a metal inductive-shunt portion 32–34, respectively, that respectively lie on the three side walls 24, 26 and 28 of non-conductive support member 21. The inductance-value of a shunt portion 32–34 is determined by the distance between the antenna's feed and the point of grounding the shunt portion, and by the vertical height of the metal loop that forms the shunt portion.

A capacitive shunt portion is formed by adding metal at a location that is close to the ground, in parallel with the shunt inductance portion, so that RF currents flow across the capacitive portion and the inductance portion.

In this embodiment of the invention, none of the three metal quarter wave monopole patterns 29–31 shown in FIGS. 2–4 includes a metal perturbation, and as shown in FIGS. 2–4, a single feed is provided for three-monopole antenna 20 by way of an electrical conductor 35 that electrically connects to the inductive shunt 34 that is a portion of the base of monopole metal pattern 31. Thus, antenna 20 provides linear polarization, monopole 31 is a fed-monopole and monopoles 29 and 33 are parasitic monopoles that are parasitically fed by fed-monopole 31.

The physical location at which conductor 35 connects to inductive shunt 34 operates to control the inductance value of the inductive shunt.

With reference to monopole 29 as shown in FIG. 3, note that each of the three bent monopoles 29–31 includes two linear metal sections 17 and 18 that are connected by a bending metal section 19.

The angle 16 of inclination of one linear section 17 to the other linear section 18 is not critical, and in this embodiment of the invention angle 16 was about 60 degrees.

As perhaps best seen in FIG. 3, the three monopoles 29–31 form a helix about the central axis 36 of antenna 20, wherein axis 36 extends generally perpendicular to the top surface 22 and the bottom surface of support member 21.

In an embodiment of the invention non-conductive support member 21 had a low dielectric constant of about 3.1, the vertex-to-vertex dimension 37 of antenna 20 was about 0.88 inch, the flat-to-flat dimension 38 was about 0.72 inch, the height 30 was about 0.28 inch, and the coupling between fed-monopole 31 and the two parasitic monopoles 29 and 30 was about −6 dB.

The invention's parasitic coupling between monopole elements is to a relatively large extent controlled by the width of a capacitive-gap that exists between the top of the three monopole elements 29–31, that is by the two generally parallel edges that are formed by the end of one monopole element and the generally middle section of an adjacent monopole element.

The bottom surface of non-conductive support member 21 carries a hexagon-shaped metal ground plane member 40 that cooperates with the metal monopoles 29–31 in a well known manner.

As described above relative to FIGS. 2–4, the present invention provides a small, low-profile, single feed, tri-filar helix antenna 20 that can be constructed and arranged to provide either linear polarization or CP.

It is now useful to consider a precursor-antenna-geometry that can be used to determine the construction and arrangement of antenna 20 as shown in FIGS. 2–4.

As used herein, the term "precursor-antenna-geometry" means an antenna like antenna 20 of FIGS. 2–4 wherein the precursor-antenna has not as yet been converted to the single feed antenna 20 that is above-described, and wherein the precursor-antenna has not as yet been converted to either linear polarization or CP.

Conversion of the precursor-antenna to a single feed antenna 20 as above-described is accomplished by providing a relatively strong coupling between the three monopoles 29–31 of the precursor-antenna, to thereby allow the monopoles of the precursor-antenna to be parasitically excited.

The behavior of the precursor-antenna is determined by feeding each of its three monopoles by way of an individual inductive shunt, i.e. in the precursor-antenna each of the three monopoles is provided with its own individual feed and feed port.

The existence of these three feed ports for the precursor-antenna, and the use of computer simulation, provides a prediction of the coupling that exists in the precursor-antenna between its three monopoles. The final design of a FIGS. 2–4 single-feed antenna 20 depends upon the magnitude of this coupling.

Figure 5:
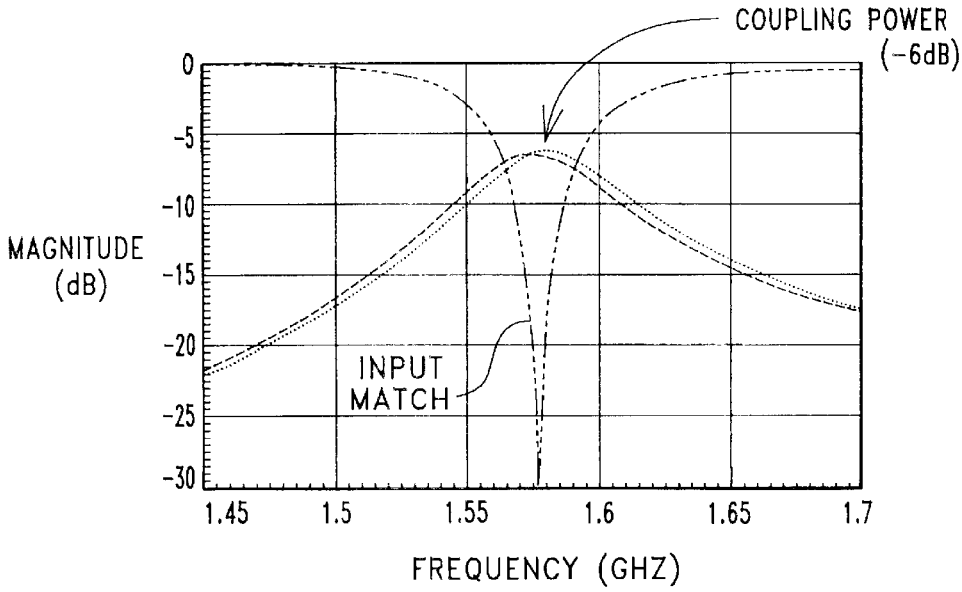
FIG. 5 shows the magnitude of the parasitic coupling (i.e. about −6 dB) between FIG. 2's directly-fed monopole and FIG. 2's two parasitically-fed monopoles, wherein about one half of the power that is feed to the directly-fed monopole is coupled to the two parasitically-fed monopoles.

An input match that is achieved in this manner is shown in FIG. 5 wherein the magnitude of the coupling between one directly-fed monopole and two parasitically-fed monopoles is about −6 dB at the center frequency of about 1.575 GHz. This input match is controlled by the physical shape of the inductive shunt 32–34 that is provided at the base of the three monopoles of the precursor-antenna.

Each monopole of the precursor antenna is a single bent quarter wave monopole, and each monopole has an input impedance that is much lower than the typical 50 ohm signal that is sent to the precursor-antenna. Hence a matching component is necessary.

Energy that is fed to any one of the three monopoles must get past that monopole's feed point before the feed energy can couple to the other two monopoles, or before this feed energy can radiate from that monopole into space. Hence this matching impedance structure of the precursor-antenna is an important portion of the final design of an antenna in accordance with the invention.

The magnitude of this coupling, approximately −6 dB from a given monopole to each of the other two monopoles, is shown in FIG. 5 wherein about one half of the power that is feed to any given monopole is coupled to the other two monopoles. The magnitude of this coupling is to a large extent controlled by the width of a capacitive gap that exists between the adjacent edges of the three monopoles that reside on the top surface of the non-conductive support member.

In the final design of the single-feed antenna 20 of FIGS. 2–4, wherein only monopole 31 is directly fed or excited, it is necessary to induce a relatively large coupling between this directly excited monopole 31 and the two parasitic monopoles 29 and 30. This relatively large coupling effectively acts as a feed network to the two parasitic monopoles 29 and 30, thereby allowing the single-feed antenna 20 to have just one of its three monopoles 29–31 directly excited. When all three of the monopoles 29–31 receive equal amounts of feed energy in the resonance condition, single-feed antenna 20 generates symmetric radiation patterns.

It has been found that a desirable design of a three-feed precursor-antenna provides that about one half of the feed energy that is provided to each of its three monopoles couples to the other two monopoles, whereas and the other half of the feed energy that is provided to each of the three monopoles radiates into free space.

When the coupling that is provided by the design of the three-feed precursor-antenna is larger than this, each monopole tends to be a poor radiator into free space, and the efficiency of the antenna suffers.

When the coupling that is provided by the design of the three-feed precursor-antenna is less than this, it is difficult for a given monopole to parasitically excite the other two monopoles, and it is difficult for the antenna to generate CP.

Figure 6:
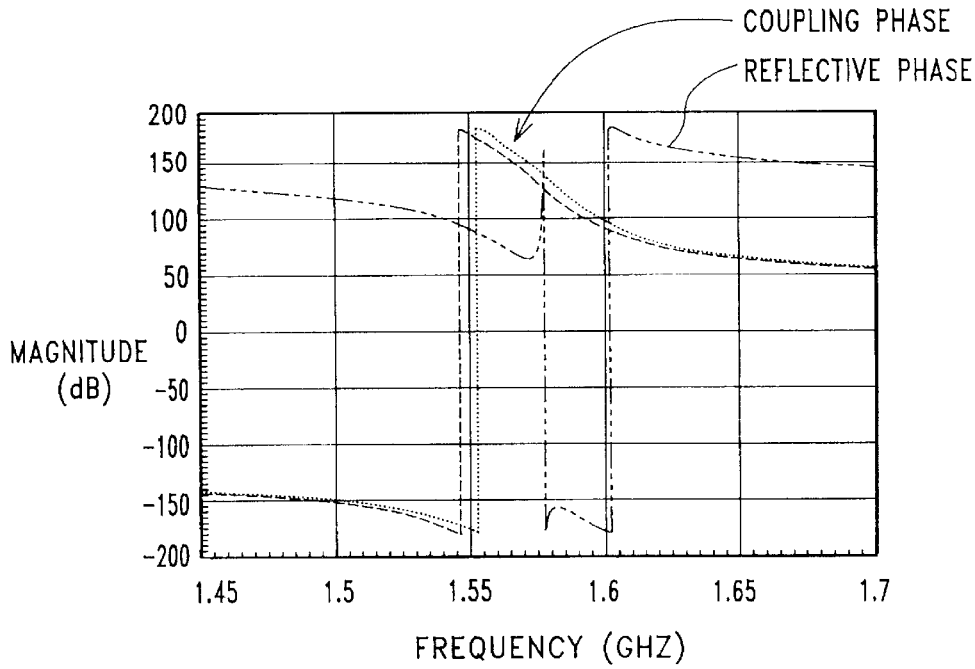
FIG. 6 shows the phase of the coupling (i.e. about plus 120 degrees) that exists between the three monopoles of FIG. 2.

In the final design of the single-feed antenna 20 of FIGS. 2–4, when no metal perturbations are provided on one or more of the two parasitic monopoles 29 and 30, the phase of the coupling between the three monopoles 29–31 is about +120 degrees, as is shown in FIG. 6. The value of this coupling phase is important in order to induce either linear polarization or CP. Metal perturbations on one or more of the two parasitic monopoles 29 and 30 offsets the resonance frequency of the one or more parasitic monopole 29/30, and also affects the phase of the coupling between the three monopoles.

As described above, FIGS. 2–4 show a single-feed, trifilar, linear polarized helix antenna 20 in accordance with the invention wherein antenna 20 exploits a strong monopole-coupling that was determined by way of the above-described investigation of a precursor-antenna wherein each of the three monopoles of the precursor-antenna were fed.

In order to generate linearly polarization, only one of the three monopoles of the FIGS. 2–4 antenna 20 needs to be directly-fed (i.e. monopole 31 in FIGS. 2–4), the two other +120 degree coupled monopoles (i.e. monopoles 29 and 30 having no perturbations in FIGS. 2–4) are coupled to the directly-fed monopole in order to generate linear polarization, and the directly-fed monopole is fed by way of an inductive shunt match (i.e. inductive shunt 34 in FIGS. 2–4.

Figure 7:
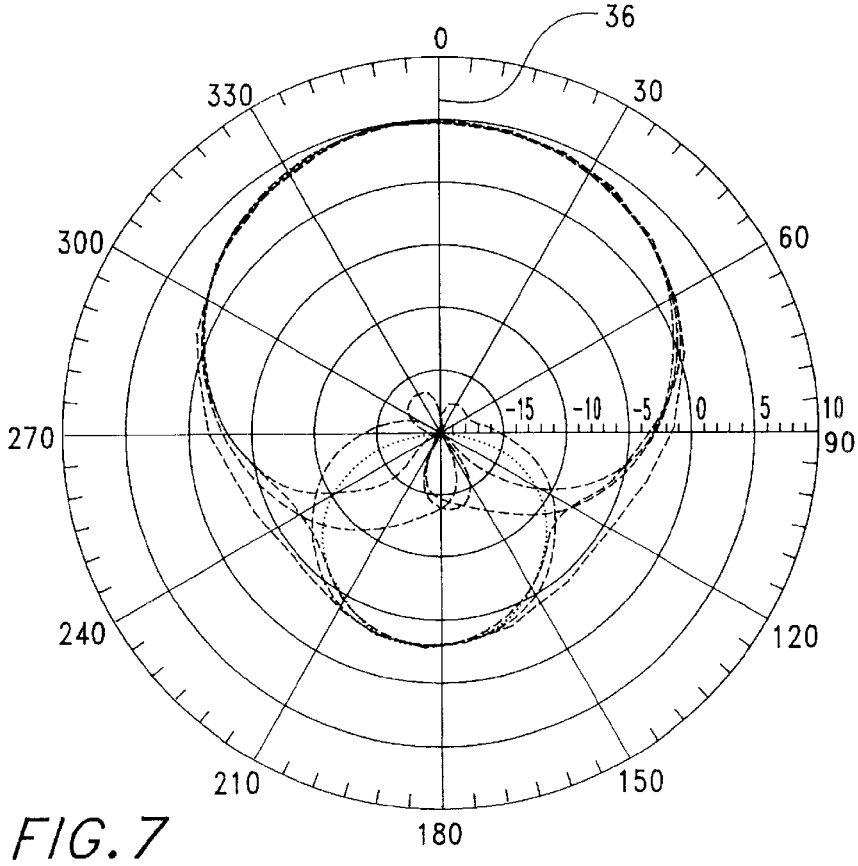
FIG. 7 shows the linear polarization pattern of the FIG. 2 antenna, this figure also showing the antenna's Directivity Pattern (dB) versus Theta at 1580 MHz, and the central axis of the antenna.

The linear polarization radiation pattern of such a tri-arm, single-feed, no-perturbation, helix antenna 20 is shown in FIG. 7, wherein this figure shows the antenna's Directivity Pattern (dB) versus Theta at 1580 MHz, and wherein this figure also shows the central axis 36 of the FIGS. 2–4 single-feed antenna 20. The FIG. 7 radiation patterns are "patch-like", following the Ludwig 3rd definition, and the antenna's polarization is parallel to axis 36 through the antenna's feed point 34 and the geometric center of antenna 20.

In order to induce CP, one of the two parasitic monopoles 29 or 30 needs to couple to fed-monopole 31 at positive 120 degrees, and the other parasitic monopole 29 or 30 needs to couple to fed-monopole 31 at negative 120 degrees.

This construction and arrangement in accordance with the invention generates an electric field that rotates uniformly with time around the outer perimeter of antenna 20. Various metal perturbation options can be used within the spirit and scope of this invention in order to generate this +120-degree/−120-degree phasing of the two parasitic monopoles.

Figure 8:
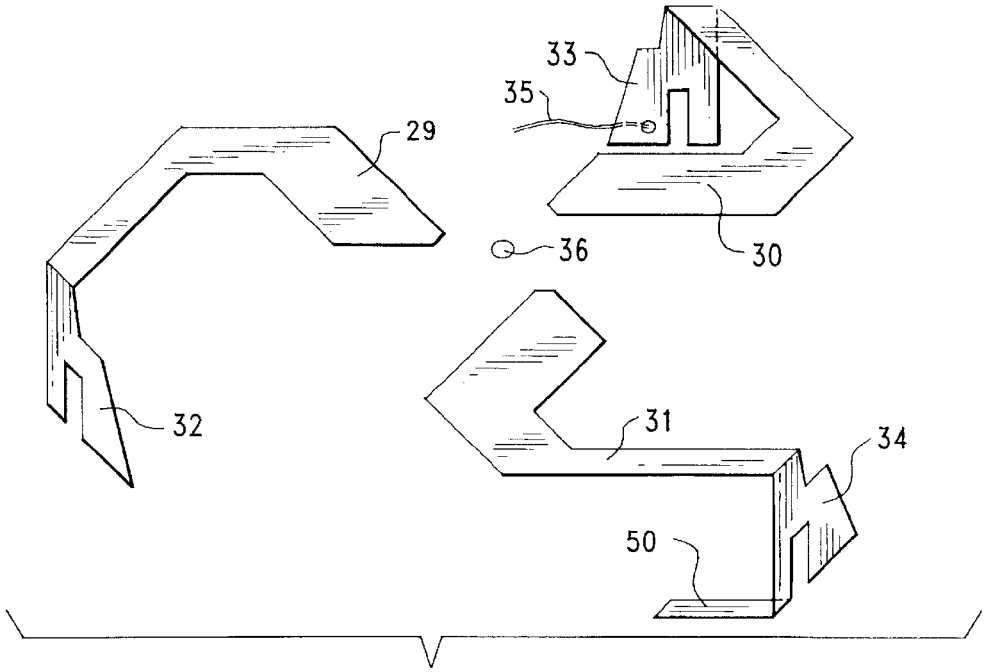
FIG. 8 shows the three metal monopoles of a dielectric-supported, single-feed CP antenna in accordance with the invention wherein a metal capacitive perturbation or stub is provided on one of the parasitic monopoles, and wherein a single-feed to the antenna is provided by way of the inductive shunt that forms a portion of a directly-fed monopole.

FIG. 8 provides a non-limiting example of a dielectric-supported, single-feed CP helix antenna 20 in accordance with the invention wherein a metal capacitive perturbation or stub 50 is provided on FIG. 4's parasitic monopole 31, and wherein the single-feed 35 to antenna 20 is provided by way of the inductive shunt 33 that forms a portion of directly-fed monopole 30.

In this embodiment of the invention monopole 30 is the directly-fed monopole, whereas the two monopoles 29 and 31 are the two parasitically-fed monopoles.

Capacitive stub 50 lies on the bottom surface of FIG. 4's non-conductive support member 21 in a manner so as to be electrically insulated from FIG. 4's ground plane 40.

Capacitive stub 50 forms a bottom metal portion of monopole 31 that extends inward and parallel to the top metal portion of monopole 31 that lies on the top surface 22 of non-conductive support member 21.

Figure 9:
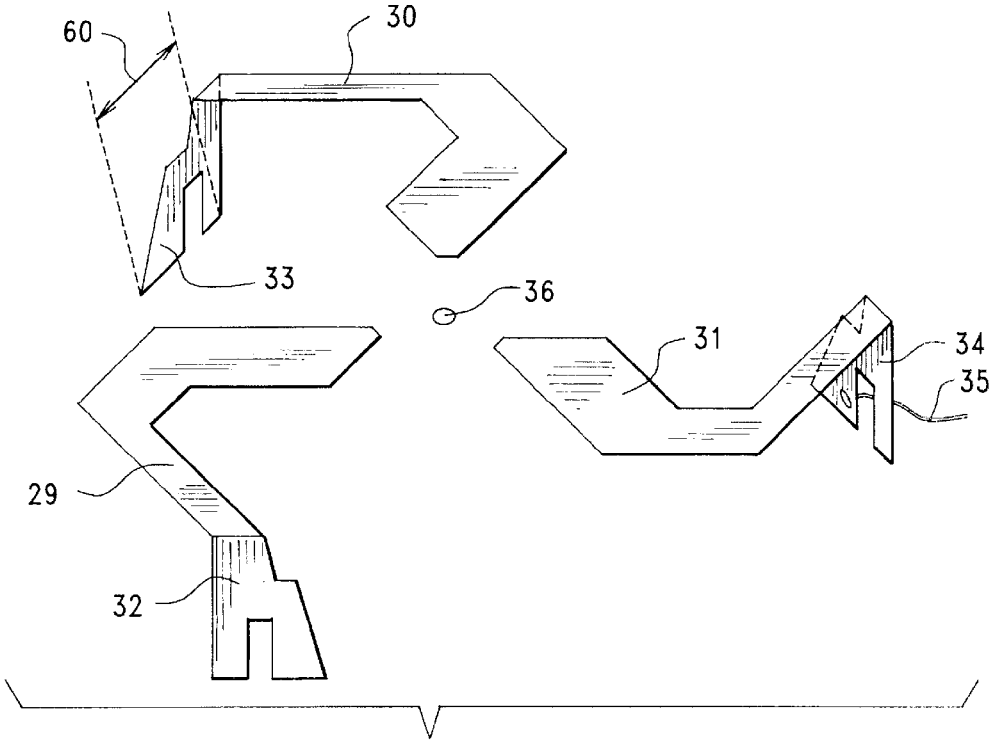
FIG. 9 shows the three metal monopoles of an antenna in accordance with the invention wherein one of the antenna's two parasitic monopoles includes an inductive metal perturbation that is provided by widening the inductive shunt that is provided at the base of this parasitic monopole.

FIG. 9 shows another embodiment of the invention wherein one of the parasitic monopoles 30 of a dielectric-supported CP antenna 20 of the type shown in FIGS. 2–4 includes an inductive metal perturbation that is provided by lowering the series inductance of the inductive shunt 33 that is provided at the base of that one parasitic monopole 30.

This lower of the inductance of the inductive perturbation occurs by virtue of the fact that a wider metal conductor that is positioned where electrical current is a maximum provides less inductance than does a thinner metal conductor.

More specifically, and with reference to FIG. 9, monopole 31 is the directly-fed monopole, monopole 29 is a parasitically-fed monopole, and monopole 30 is a parasitically-fed monopole that includes an inductive metal perturbation that is provided by a relatively wide (see dimension 60) metal inductive shunt 33.

In other embodiments of the invention, both of the parasitic monopoles may include metal perturbations. For example, one parasitic monopole may include a capacitive stub such as shown in FIG. 8, and the other parasitic monopole may include a series inductance as shown in FIG. 9.

In addition, a relatively small change in the shape of a parasitic monopole, at its base and/or at its top portion, will create a metal perturbation that changes the phase of the coupling to the directly-fed monopole.

In addition, the sense of the CP can be reversed by switching a perturbation from one parasitic monopole to the other parasitic monopole.

Figure 10:
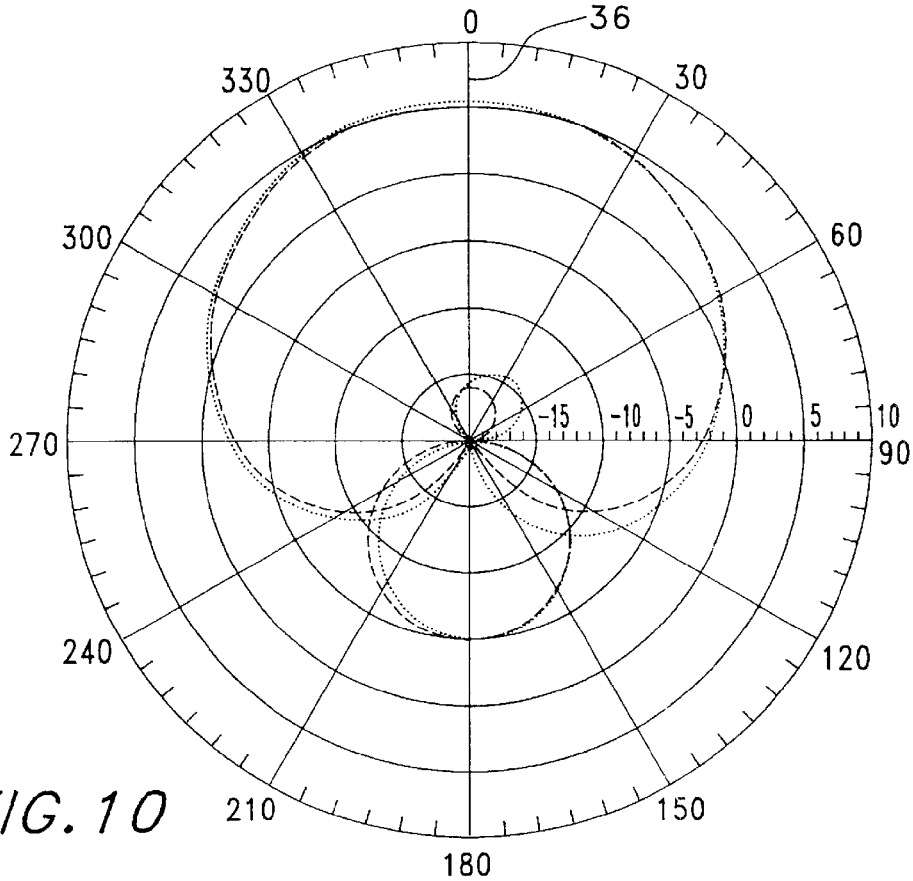
FIG. 10 shows the Antenna Directivity Pattern (dB) versus Theta at about 1587.5 MHz for an antenna in accordance with the invention, this figure showing the right-hand and the left-hand radiation patterns at the center frequency of about 1587 MHz for a CP antenna wherein the axial ratio is nearly perfect at 0 dB.

FIG. 10 shows an Antenna Directivity Pattern (dB) versus Theta at about 1587.5 MHz for an antenna 20 in accordance with the invention, this figure showing the right-hand and the left-hand radiation patterns at the center frequency of about 1587 MHz for the CP antenna 20, wherein the axial ratio is nearly perfect at 0 dB.

Figure 11:
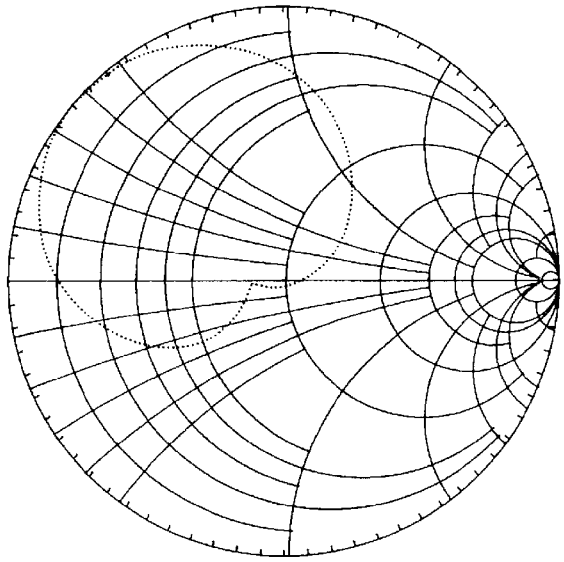
FIG. 11 shows a Smith chart for an antenna in accordance with the invention.
Figure 12:
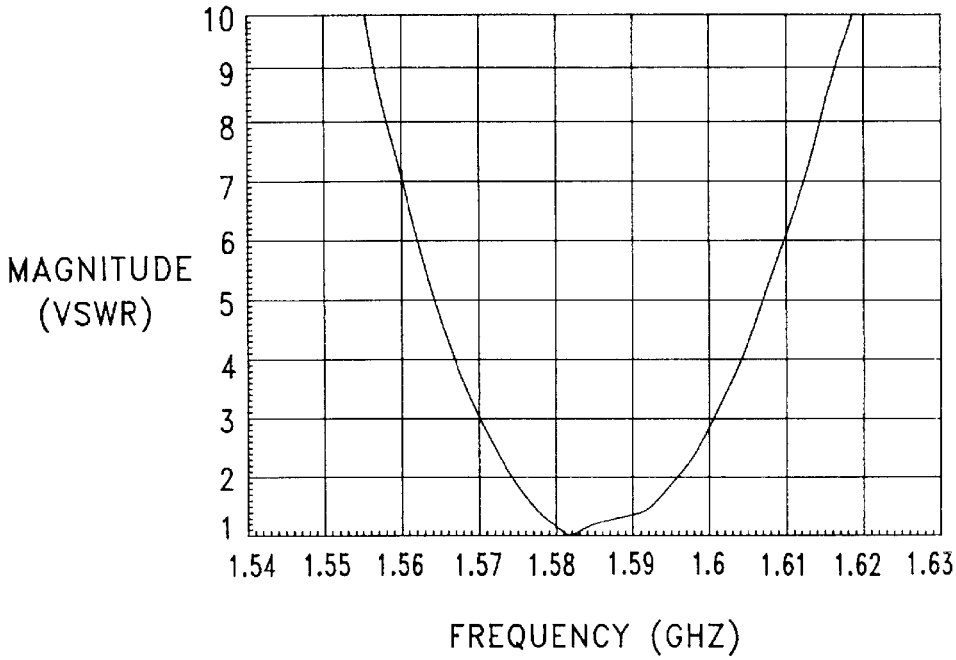
FIG. 12 shows the VSWR bandwidth for an antenna in accordance with the invention.

FIG. 11 shows a Smith chart, and FIG. 12 shows the voltage-standing-wave-ratio (VSWR) bandwidth for such an antenna 20 in accordance with the invention.

Antennas 20 in accordance with the invention provide better efficiency, as is typical with most antennas, when antenna 20 is wider (see dimensions 37 and 38 of FIG. 2) or taller (see dimension 39 of FIG. 2). Better efficiency is achieved using taller antennas 20, under the constraint that the above-described strong coupling between the three monopoles is maintained. Providing a taller antenna 20 in accordance with the invention may become impractical after a certain height 39 has been achieved due to the fact that the directly-fed monopole becomes so efficient that it, in itself, radiates most of its energy into space before a portion of this energy can be coupled to the two parasitically-fed monopoles. In this limiting height case, antennas 20 in accordance with the invention may function as a single bent monopole antenna.

Spacing the three bent quarter wave monopoles of an antenna 20 in accordance with this invention farther away from each other may increase the efficiency of the antenna. However, again the above-described monopole coupling must be maintained. That is, the three monopoles must be physically close enough so that significant coupling occurs.

Figure 1A:
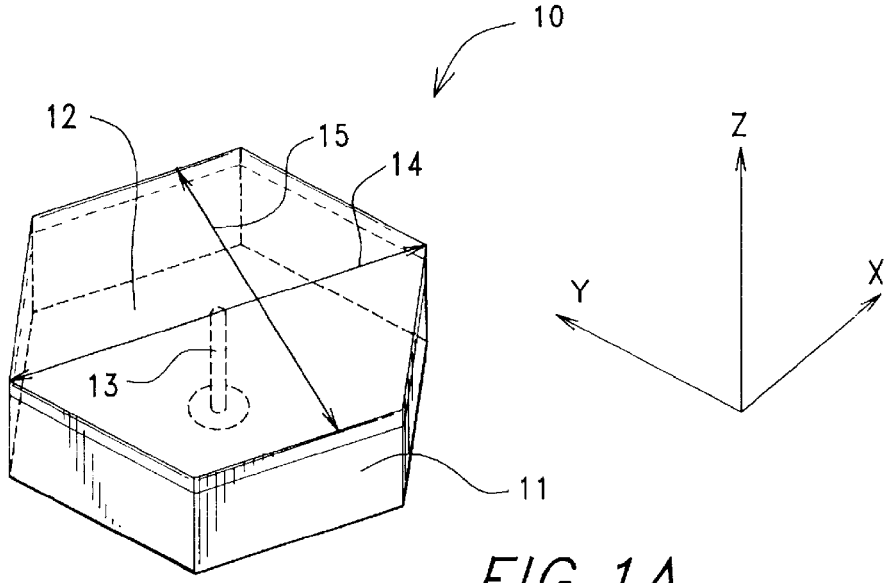
FIG. 1A (PRIOR ART)
FIG. 1A shows a standard-technology, dielectric-loaded, ceramic-body, hexagon-shaped patch antenna that is tuned to the GPS frequency, wherein a high dielectric constant ceramic body member is used to reduce the physical size of the antenna.
Figure 1B:
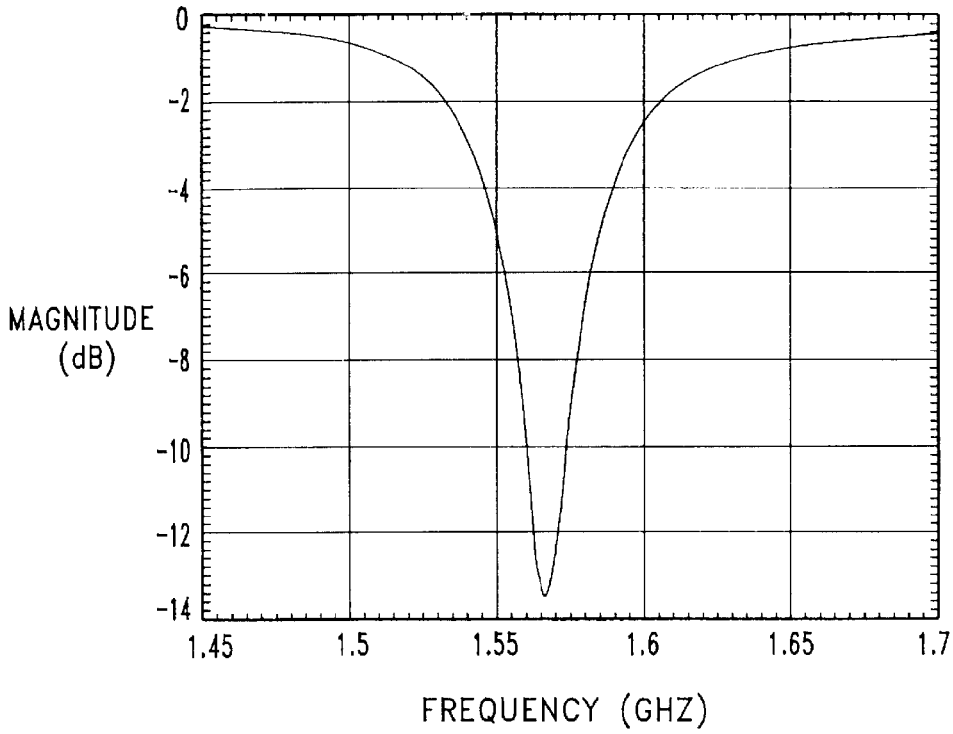
FIG. 1B (PRIOR ART)
FIG. 1B shows the frequency/magnitude characteristic of the antenna of FIG.1A.

Note that antennas in accordance with this invention, using very little dielectric loading, have the same small physical size as the highly dielectrically loaded patch antenna 10 that is shown in FIG. 1A. Hence antennas in accordance with this invention can replace dielectrically-loaded, single-feed CP patch antennas of the same physical size, and antennas in accordance with the invention do not require dielectric loading. Thus antennas in accordance with the invention are a less expensive choice, especially for narrow band CP applications.

Various manufacturing methods can be used to produce single-fed, tri-filar helix antennas in accordance with this invention.

For example, and with reference to FIGS. 2–4, antenna 20 can be made using a two-shot molding process wherein a first-shot of a polymer material is used to form the major portion of non-conductive support 21, and wherein a second-shot of a different polymer material is used to form those portions of antenna 20 that correspond to the metal portions of antenna 20. These portions of the second polymer material are then treated in a well known manner to facilitate the deposition or plating of metal onto these second polymer portions.

Other manufacturing techniques include a two-shot molding process wherein metal monopole elements are placed on the top and on the bottom of a molded polymer member in order to create a low-dielectrically loaded antenna; insert molding of an antenna having the above described metal portions; a hybrid antenna that includes an etched printed circuit board (PCB) and stamped metal portions; a completely PCB antenna; and an antenna that includes free-standing metal portions.

Figure 13:
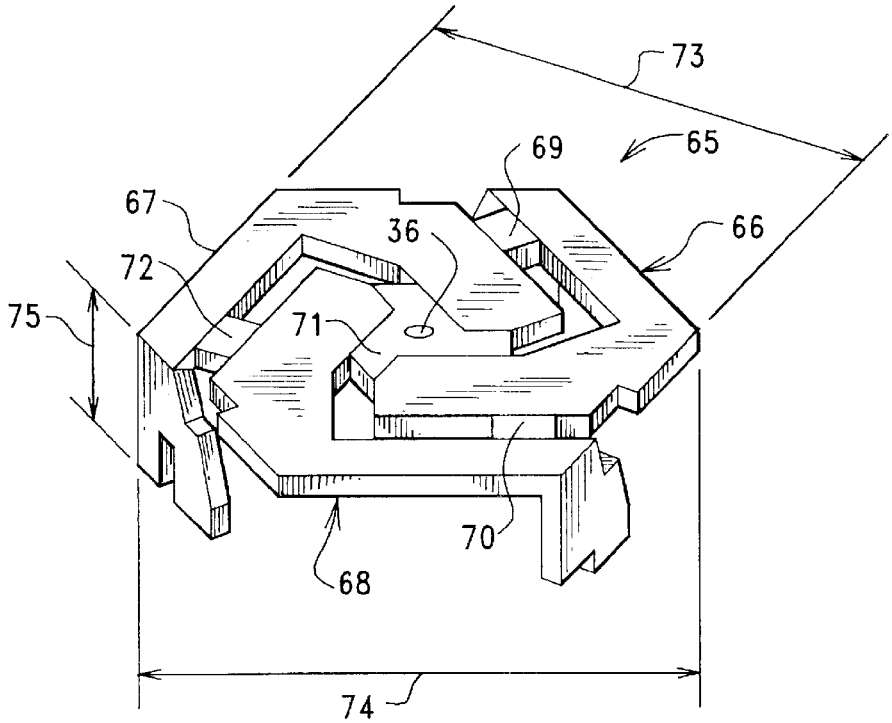
FIG. 13 shows a two-shot-molded tri-arm, single feed, helix antenna in accordance with the invention that is tuned to about 1.575 GHz.

FIG. 13 shows a two-shot-molded tri-arm helix antenna 65 in accordance with the invention that is tuned to about 1.575 GHz.

In a non-limiting embodiment of the invention antenna 65 had a flat-to-flat dimension 73 of about 0.88 inch, a vertex-to-vertex dimension 74 of about 1.01 inch, and a height dimension 75 of about 0.30 inch.

Antenna 65 includes three not-plated plastic portions 69–72 and three metal-plated plastic portions 66–68. Not-plated plastic portions 69–72 provide the mechanical support for antenna 65. Metal plated portions 66–68 comprise three metal antenna monopoles as above described, one monopole of which is directly-fed, and the other two of which are parasitically-fed monopoles. Plated metal portions 66–68 are nearly fully covered by a metal in order to reduce dielectric loss and in order to reduce dielectric loading, which would reduce the bandwidth of antenna 65.

One advantage of the FIG. 13 embodiment of the invention is that "lossy" plastics can be used without reducing the efficiency of antenna 65. Another advantage is that two-shot molding achieves tight mechanical tolerances for the construction and arrangement of antenna 65.

Figure 14:
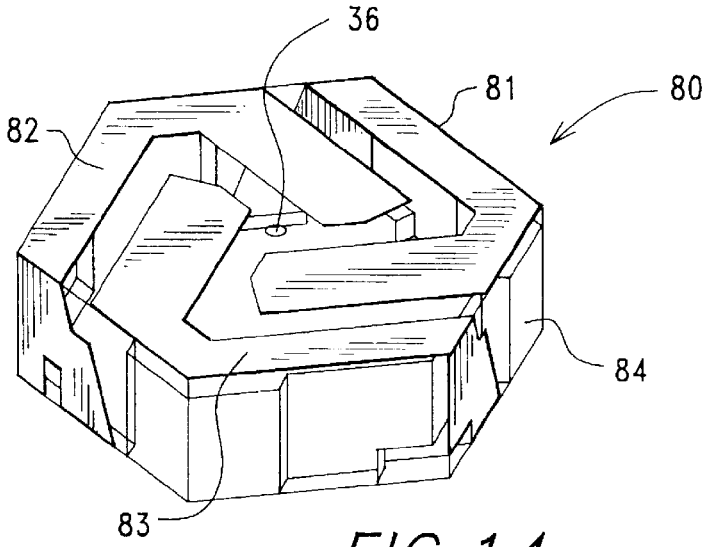
FIG. 14 shows an embodiment of the invention wherein a single-fed, three monopole helix antenna includes three stamped-metal monopole elements that are mounted onto the outer surface of an injection molded plastic and non-conductive support member.

FIG. 14 shows an embodiment of the invention wherein a single-feed, three monopole helix antenna 80 includes three stamped-metal monopole elements 81–83 that are mounted onto an injection-molded plastic and non-conductive support member 84. Tri-monopole helix antenna 80 is tuned to about 1.575 GHz. In accordance with the above description, one of the three metal monopoles is directly-fed, and the other two of the metal monopoles are parasitically-fed from the directly-fed monopole.

An advantage of antenna 80 is low cost in that after plastic molding, metal-stamping and metal-bending tools are made, antenna 80 can be manufactured from a sheet metal and a plastic material that are relatively inexpensive.

Figure 15:
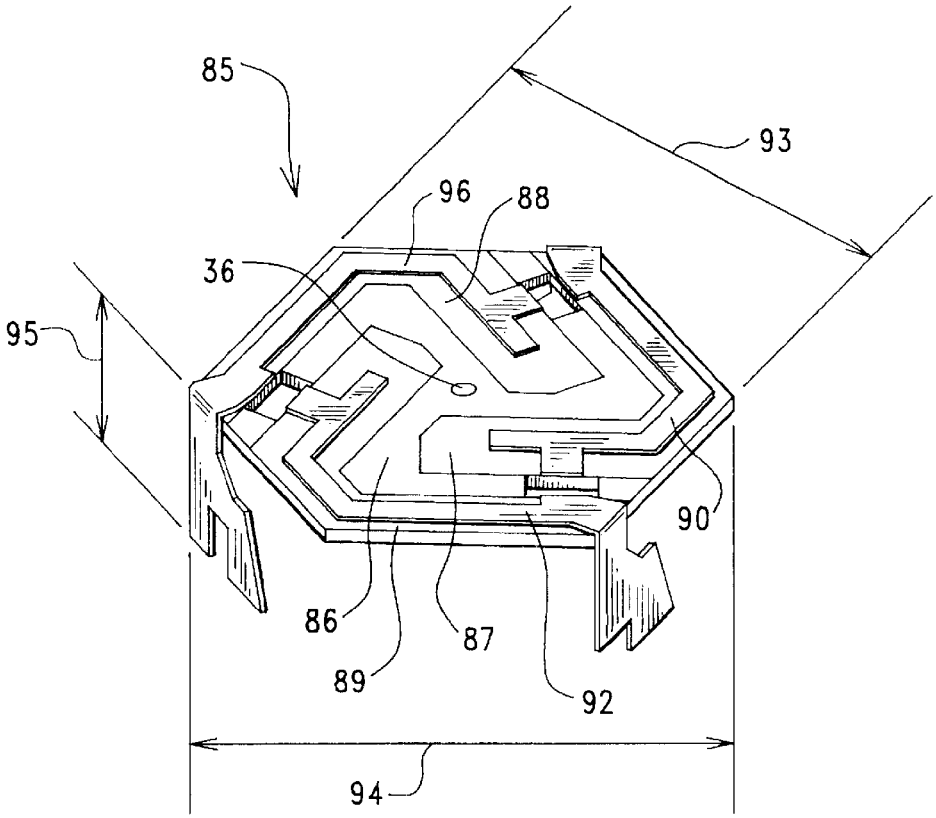
FIG. 15 shows a single-feed, three-monopole helix antenna in accordance with the invention that is made from a printed circuit board that includes three etched areas, each of the three etched areas including a metal monopole element tuned for about 1.575 GHz, wherein the antenna is tuned for CP by using a series inductance (i.e. a wider inductive shunt) in one of the parasitically-fed monopoles.

FIG. 15 shows a single-feed, three-monopole helix antenna 88 that is made from a PCB 86 that includes three etch dielectric areas 87–89 areas. Each of the three etched dielectric areas 87–89 includes a stamped-metal monopole element 90–92 that is tuned for about 1.575 GHz. As before, one of the three monopoles 90–92 is directly-fed, and the other two monopoles are parasitically-fed from the directly-fed monopole. Antenna 88 is tuned for CP by using a series inductance (i.e. a wider inductive shunt) at the base of the directly-fed monopole.

In a non-limiting embodiment of antenna 85, the flat-to-flat dimension 93 was about 0.76 inch, the vertex-to-vertex dimension 94 was about 0.27 inch, and the height dimension 95 was about 0.27 inch.

An advantage of FIG. 15's antenna 88 is that mechanical support is provided by thin PCB 86, and as a result the material-cost of antenna 88 is minimized. Another advantage to the FIG. 15 antenna is that etching provides tight tolerances on the top surface of the antenna.

Figure 16:
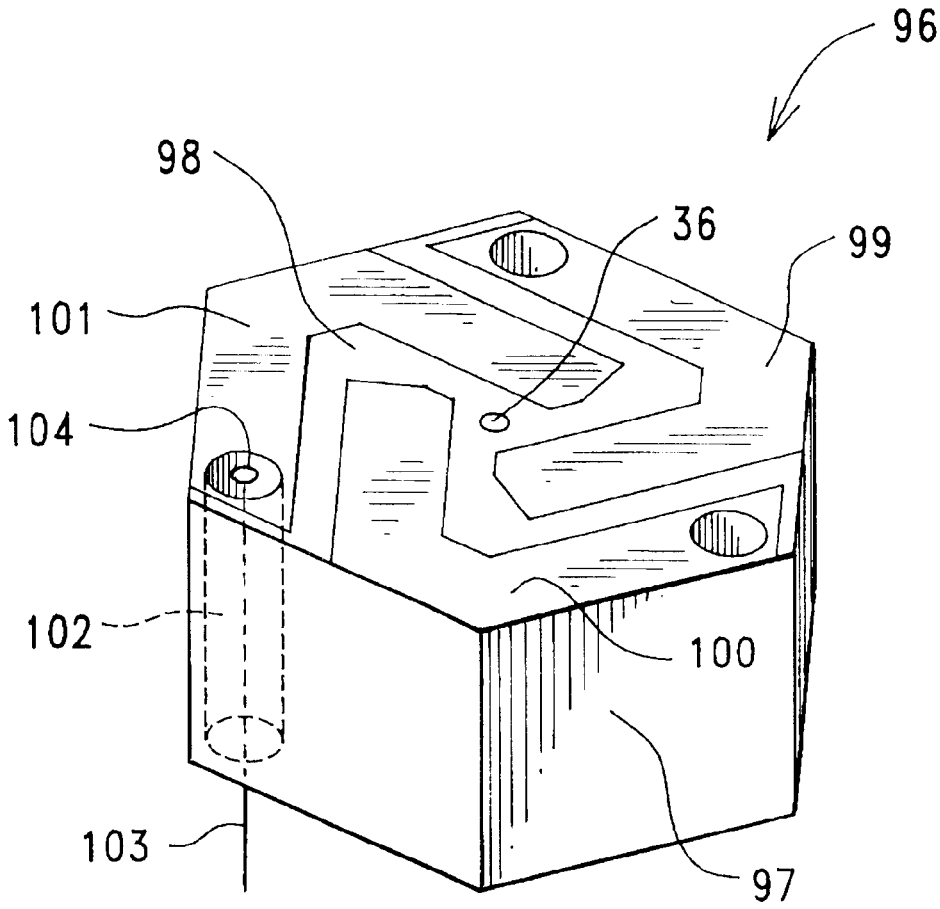
FIG. 16 shows an antenna in accordance with the invention wherein the antenna's dielectric support is provided by a printed circuit board whose top surface is etched to provide three metal monopole elements, and wherein the printed circuit board includes a through-hole or a via through which a feed conductor is threaded and then connected to the directly-fed monopole.

FIG. 16 shows an antenna 96 in accordance with the invention wherein the antenna's dielectric support function is provided by a PCB 97 whose top surface 98 is etched to provide three metal quarter wave monopole elements 99-101. PCB 97 includes a through-hole or via 102 through which a feed conductor 103 is threaded and then connected to monopole 101 at location 104. Thus, monopole 101 is the directly-fed monopole, and monopoles 99 and 101 are parasitically-fed from directly-fed monopole 101.

Antenna 96 can be tuned for CP by providing a discrete reactive electrical element in series with feed conductor 103.

Antenna 96 provides an advantage in that little or no capital cost or specialized tooling is required. As a result, the tuning of antenna 96 can be integrated into each individual antenna platform.

In summary, it can be seen that the present invention provides a small, low-profile, tri-filar, single-feed, helix antenna that includes three bent quarter wave metal monopoles. The three bent-monopoles are positioned at about 0 degrees, 120 degrees, and 240 degrees about the top surface of the antenna. The perimeter of the antenna that supports the three bent-monopoles can be a hexagon, or it can be another shape such as a circle or a shape that approaches a circle. Only one of the three quarter wave monopoles is fed, for example, with an inductive shunt match, and the other two monopoles are excited parasitically from the fed-monopole. Linear polarization is produced when no metal perturbation is applied to the two parasitic monopoles, such that both parasitic monopoles are parasitically excited in phase at positive 120 degrees. In order to produce CP, metal perturbations are applied to at least one of the two parasitic monopoles in order to generate positive 120 degrees coupling in one of the two parasitic monopoles and negative 120 degrees in the other of the two parasitic monopole. Various metal perturbation options are available in order to generate this phasing: For example, one of the parasitic monopoles can have a capacitive shunt, and the other parasitic monopole can have an inductive shunt. Or, only one parasitic monopole need be provided with a metal perturbation, either capacitive or inductive, depending on the sense of the CP that is desired. These electrically reactive metal perturbations can be provided by either shaping the metal legs or metal base of the parasitic monopoles, or by the electrical connection of discrete electrically reactive components in series with the parasitic monopoles.

In order to induce CP operation, the resonant frequency of one or both of the above-described parasitic monopole elements is shifted such that one of the parasitic elements couples at positive 120 degrees to the directly-fed monopole element, and such that the other of the parasitic elements couples at negative 120 degrees to the directly-fed monopole element.

In order to induce this CP operation, a perturbation can be provided on one or both of the above-described parasitic monopoles, and various perturbations options can be used to generate the phasing that is required for CP. In FIG. 8 a perturbation 50 is provided as an extended portion of parasitic monopole 31. In FIG. 9 parasitic monopole 30 is provided with a perturbation in the form of a wide shunt 33 (see width dimension 60).

More generally, relatively small changes in the geometric shape of a parasitic monopole can create a perturbation that controls the phasing of the parasitic monopole relative to the directly-fed monopole. Non-limiting geometric-shape examples are increasing a monopole-length as in FIG. 8, and/or increasing a monopole-width as in FIG. 9, both of which change the phase of the coupling of a parasitic monopole to the directly-fed monopole.

The perturbation options or means available to generate the phasing that is required for CP operation including, but are not limited to, increasing or decreasing a length or width of a parasitic monopole, and/or providing one of the parasitic monopoles with a capacitive perturbation shunt as the other parasitic monopole is provided with an inductance perturbation.

Only one parasitic element need have a perturbation, either capacitive or inductive, depending upon the sense of the CP that is desired. FIG. 8 shows the use of a capacitive perturbation 50 that extends inward from the base of parasitic monopole element 31. FIG. 9 shows an inductive perturbation that is formed by a wide portion 60 at the base of parasitic monopole element 30, it being noted that wide metal conductors that are positioned where current is at a or near maximum have less inductance than thinner metal conductors.

Thus, CP can be induced by perturbations that are associated with one or more of the two parasitic monopoles, including, but not limited to, in FIG. 8 providing a metal perturbation 50 at the end of parasitic monopole 31, in FIG. 9 providing a metal perturbation at the end of parasitic monopole 30 by providing of a relatively wide metal shunt 33, and more generally by changing the geometric shape of a parasitic monopole at any position along the length of the parasitic monopole, such that the phase of the parasitic monopole's coupling to the directly fed monopole results in CP operation.

While the present invention has been described with respect to certain preferred embodiments of the invention, modifications and variations may be employed without departing from the spirit and scope of the present invention as set forth in the following claims.

What is claimed is:

1. A method of making a single-feed, three-monopole, circularly polarized, helix antenna, comprising the steps of:

providing a first, a second and a third monopole element, each of said monopole elements having a first and a second end portion;

physically positioning said first, second and third monopole elements at about 0-degrees, 120-degrees, and 240-degrees, respectively, around a central axis such that said first end portions of said first, second and third monopole elements are located physically adjacent to said central axis, and such that said first, second and third monopole elements are relatively strongly coupled;

connecting an antenna-feed to said first monopole element such that said first monopole element is a directly-fed monopole element, and such that said second and a third monopole elements are parasitically-fed from said first monopole element;

providing perturbation-means on at least one of said second and third monopole elements; and controlling said perturbation-means on said at least one of said second and third monopoles in a manner to produce a plus 120 degree coupling of said second monopole element to said first monopole element, and in a manner to produce a minus 120 degree coupling of said third monopole element to said first monopole element.

2. The antenna of claim 1 including the step of:

controlling a geometric shape of said perturbation-means.

3. The antenna of claim 1 including the step of:

providing said first, second and third monopole elements as quarter wave monopole elements.

4. The antenna of claim 1 including the step of:

providing that said relatively strong coupling between said first, second and third monopole elements results in about one-half of feed-energy applied to said antenna feed being radiated from said first monopole element into space, as a remaining portion of said feed-energy is parasitically coupled to said second and third monopole elements.

5. The method of claim 1 wherein said relatively strong coupling has a magnitude of about −6 dB.

6. The method of claim 1 including the step of:

locating said perturbation-means on at least one of said second and third monopole elements generally at said second end of said at least one of said second and third monopole elements.

7. The method of claim 1 including the step of:

physically positioning said first, second and third monopole elements in a generally common plane.

8. A method of making a circularly polarized antenna, comprising the steps of:

providing a first, a second and a third quarter-wave monopole element, each of said monopole elements having a first end portion and a second end portion;

physically positioning said first, second and third monopole elements at about 0-degrees, 120-degrees, and 240-degrees, respectively, in a common plane and around a central axis that extends generally perpendicular to said common plane such that said first end portions of said first, second and third monopole elements are located physically adjacent to each other and to said central axis, and such that said first, second and third monopole elements are relatively strongly coupled;

connecting an antenna-feed to said first monopole element such that said first monopole element is a directly-fed monopole element, and such that said second and a third monopole elements are parasitically-fed from said first monopole element;

providing a perturbation generally at said second end of at least one of said second and third monopole elements; and controlling a geometric shape of said metal perturbation on said at least one of said second and third monopoles in a manner to produce a plus 120 degree parasitic coupling of said second monopole element to said first monopole element, and in a manner to produce a minus 120 degree parasitic coupling of said third monopole element to said first monopole element.

9. The antenna of claim 8 including the step of:

providing that said relatively strong coupling between said first, second and third monopole elements results in about one-half of feed-energy applied to said antenna feed being radiated from said first monopole element, as a remaining portion of said feed-energy is parasitically coupled to said second and third monopole elements.

10. The method of claim 9 wherein said relatively strong coupling has a magnitude of about −6 dB.

11. In a helical antenna having three monopole elements, a first of which is directly-fed, and a second and third of which are parasitically coupled to said directly fed monopole element, an improvement comprising:

means for shifting a resonant frequency of at lease one of said second and third monopole elements in a manner such that one of said second and third monopole elements couples to said directly-fed monopole element at positive 120 degree and such that another of said second and third monopole elements couples to said directly-fed monopole element at negative 120 degrees.

12. The improvement of claim 11 wherein said means for shifting a resonant frequency of at least one of said second and third monopole elements comprises:

a capacitive perturbation associated with said one of said second and third monopole elements and/or an inductive perturbation associated with said another of said second and third monopole elements.

* * * * *